US006785932B2

(12) United States Patent
Bone

(10) Patent No.: US 6,785,932 B2
(45) Date of Patent: Sep. 7, 2004

(54) AIR FLOW MODIFICATION IN VACUUM CLEANERS

(75) Inventor: Daniel Bone, Langley Moor (GB)

(73) Assignee: Black & Decker Inc., Newark, DE (US)

( * ) Notice: Subject to any disclaimer, the term of this patent is extended or adjusted under 35 U.S.C. 154(b) by 160 days.

(21) Appl. No.: 10/091,137

(22) Filed: Mar. 4, 2002

(65) Prior Publication Data

US 2003/0005546 A1 Jan. 9, 2003

(30) Foreign Application Priority Data

Jul. 6, 2001 (GB) ..... 0116584

(51) Int. Cl.[7] ..... A47L 5/32
(52) U.S. Cl. ..... 15/334
(58) Field of Search ..... 15/331, 334, 337; 55/DIG. 3

(56) References Cited

U.S. PATENT DOCUMENTS 2,230,077 A * 1/1941 Foss ..... 15/329
3,300,806 A * 1/1967 Ripple ..... 15/334
3,618,158 A * 11/1971 Worwag ..... 15/332
4,563,790 A 1/1986 Clark
5,355,549 A * 10/1994 Steinberg et al. ..... 15/334
5,586,358 A 12/1996 Wolfe et al.
5,608,945 A 3/1997 Crouser et al.
6,317,920 B1 * 11/2001 Brickner et al. ..... 15/334

FOREIGN PATENT DOCUMENTS

| | | |
|---|---|---|
| EP | 0 551 070 | * 7/1993 |
| GB | 2325399 | * 11/1998 |
| GB | 2329326 | 7/2001 |

* cited by examiner

*Primary Examiner*—Terrence R. Till
(74) *Attorney, Agent, or Firm*—Harness, Dickey & Pierce, P.L.C.

(57) ABSTRACT

A Vacuum Cleaner (1) having a removable dust collection bowl (5) through which the air flow passes so as to deposit dirt carried on the air flow. The dust bowl (5) contains a closure member (7) which is slidably displaceable relative the dust bowl (5) so as to simultaneously close a first air inlet (33) into the dust bowl (5) while opening a second air flow path (61) to the dust bowl (5) that is remote from the first air flow path (33). The second air flow path allows an external hose connector to be coupled in air flow communication with the dust bowl. The closure member (7) comprises a slidable shuttle cassette.

29 Claims, 9 Drawing Sheets

AIR FLOW MODIFICATION IN VACUUM CLEANERS

TECHNICAL FIELD

This invention relates to component parts of vacuum cleaners adapted to be able to change the air flow path through the vacuum cleaner in use, and particularly to such parts that are able to change the air flow path so as to convert the vacuum cleaner for hose attachment.

BACKGROUND OF THE INVENTION

The use of hose conversion in vacuum cleaners, e.g. to adapt the cleaners to above the floor use, is well known in the cleaner art. Many adaptations use a conversion valve, which is arranged to move to provide suction at a floor nozzle, or alternatively at a hose end. Examples of such valve use include U.S. Pat. No. 1,936,761 (Hoover, 1933), U.S. Pat. No. 2,867,833 (Hoover, 1959), and U.S. Pat. No. 4,373,228 (Dyson 1983).

U.S. Pat. No. 1,936,761 describes a rotatable valve provided in a nozzle which is provided with a cut away portion so that when rotated it can seal one conduit and open another conduit or vice versa, for attachment of a dusting tool or for floor cleaning.

U.S. Pat. No. 2,867,833 describes an upright cleaner in which insertion of a hose into a converter tube pushes a valve to close the upper end of a suction tube extending from the floor nozzle of the vacuum cleaner so that suction is drawn instead through the hose attachment.

It is also known to achieve hose conversion by means other than a valve.

In U.S. Pat. No. 4,373,228 conversion of a vacuum cleaner from upright to cylinder mode operation is achieved by insertion and retraction of a hose attachment. This hose movement causes a valve to move from a position in which the valve opens the inlet pipe of the appliance and closes communication to the hose attachment, to a position in which the hose attachment communication is open and the main inlet is closed.

In U.S. Pat. No. 5,713,103 (Hoover, 1998) hose conversion is achieved directly adjacent the dirt cup of a dirt cup cleaner. In this reference an adapter mounting array is mounted over a conversion stub conduit that is integral with, and in communication with the suction tube of the dirt cup cleaner. In the non-converted position the conversion stub conduit is closed by a door, and in the converted position the door is lifted and a hose fitting is inserted into the stub conversion conduit. The hose fitting is shaped to close the port at the upper end of the suction tube of the vacuum cleaner, thereby sealingly closing off the suction tube. In this position there is direct flow through the hose fitting to the dirt cup entrance port.

EP-A-0783865 (Application number 97300134.0-2316, Black and Decker Inc) describes a known vacuum cleaner comprising a floor travelling head incorporating dust collection bowl, an impeller, a motor and rechargeable batteries for powering the motor. A floor nozzle leads through a single front inlet into a generally cup shaped dust collection bowl, and exits through a back face that comprises a filter extending over the length of the back face and a cover partially covering the filter. Air exits the dust collection bowl to the rear, impelled by the impeller, which is positioned to the rear of the dust collection bowl, and exits the floor travelling head through an air vent slot on the upper surface of the floor travelling head. This reference does not describe the use of hose conversion.

SUMMARY OF THE INVENTION

It is an object of all aspects of the present invention to provide arrangements for altering the air flow path into component parts of a vacuum cleaner, e.g. into a dust collection module, into a suction tube etc.

It is another object of all aspects of the present invention to provide arrangements that can be used to modify the floor travelling head of the reference EP-A-0783865 (Application number 97300134.0-2316, Black and Decker Inc) to make it suitable for hose conversion.

The first aspect of the present invention provides a kit of parts comprising:

a) a removable dust collection module for use in a vacuum cleaner, which in use forms part of the air flow path through the vacuum cleaner;

(b) a closure member arranged to be moved relative to the collection module so as simultaneously to close a first air flow path into the dust collection module and to open a second air flow path into the dust collection module that is remote from the first air flow path, or vice versa.

Thus the closure member can be moved from a first position in which a first air flow path is open and a second air flow path is closed to a second position in which the second air flow path is open and the first air flow path is closed. This change in open air flow path may conveniently be used for conversion for hose attachment use, the first air flow path being through a floor inlet in the vacuum cleaner into the dust collection module, and the second air flow path being through a separate inlet, suitable for hose attachment, and in communication with the dust collection module. The separate inlet may be positioned elsewhere in the vacuum cleaner, e.g. on an upper or side surface of the vacuum cleaner.

In contrast to the change in air flow path achieved during hose conversion in U.S. Pat. No. 5,713,103, according to the first aspect of the present invention the changed air flow path into the dust collection module is remote from the first air flow path into the dust collection module.

In a preferred embodiment the dust collection module comprises first and second air inlets, and movement of the closure member acts simultaneously to cover the first air inlet and to uncover the second air inlet or vice versa, thereby simultaneously closing the first air flow path into the dust collection module and opening the second air flow path into the dust collection module, or vice versa. Therefore the closure member moves from a first position in which it covers the first air inlet of the dust collection module but not the second air inlet of the dust collection module to a second position in which it covers the second air inlet of the dust collection module but not the first air inlet of the dust collection module.

The first and second air inlets are preferably spaced from each other. This arrangement therefore conveniently achieves two air flow paths into the dust collection module that are remote from each other according to the first aspect of the present invention.

Where the dust collection module comprises first and second air inlets these are preferably provided on a common surface of the dust collection module, e.g. on a front surface.

In a preferred embodiment the dust collection module comprises first and second air inlets and the closure member is a shuttle member that can be slid relative to the dust collection module simultaneously to cover the first air inlet and uncover the second air inlet to effect the said closure and opening of the said first and second air flow paths. Preferably the closure member and dust collection module comprise corresponding, preferably mating surfaces which can slide relative to each other to effect the air flow path changes. In this embodiment the shuttle member may, or may not comprise one or more apertures or other inlets. If it contains no inlets then it is preferably moved from a position in which one edge of the member skirts the first inlet of the dust collection module, while the remainder of the shuttle member covers the second air inlet of the dust collection module, to a position in which another edge (or another part of the same edge, e.g. curved or stepped edge) of the shuttle member skirts the second inlet, while the remainder of the shuttle member covers the first inlet of the dust collection module.

Whether or not there is sliding motion between the dust collection module and the closure member, the dust collection module preferably comprises first and second air inlets and the closure member preferably comprises a shuttle member that also comprises at least one opening. In this case, the closure member can preferably be moved relative to the said air inlets of the dust collection module so that in a first shuttle position the first, but not the second, air inlet of the dust collection module of the vacuum cleaner is in register with the shuttle opening, and in a second shuttle position the second, but not the first, air inlet of the dust collection module of the vacuum cleaner is in register with the or another shuttle opening. Most preferably the shuttle member comprises two shuttle openings (first and second shuttle openings) and the closure member can be moved relative to the said air inlets so that in a first shuttle position the first air inlet of the dust collection module is in register with the first shuttle opening but the second air inlet of the dust collection module is not in register with any shuttle opening, and in a second shuttle position the second air inlet of the dust collection module is in register with the second shuttle opening, but the first air inlet of the dust collection module is not in register with any shuttle opening.

It is also envisaged that more than two dust collection module inlets could be present, and/or more than two shuttle openings may be present. These could be arranged to be in register with each other at different positions of the shuttle member so as to achieve three or more different air flow paths into the dust collection module.

The or each shuttle member opening preferably comprises an aperture or a tubular inlet.

In one embodiment the closure member is a shuttle member that is at least partly contained within the dust collection module. Preferably the dust collection module comprises one or more air inlets, and the shuttle member is located adjacent an inner inlet-containing-surface of the dust collection module. This or any other location of the shuttle member is preferably achieved using a shuttle backing plate. The shuttle backing plate is preferably positioned to locate the shuttle member between itself and the dust collection module. Especially preferably the backing plate provides a channel between itself and a surface of the dust collection module, in which channel the shuttle member can slide.

The dust collection module, and closure member or shuttle member, and the shuttle backing plate if present, preferably have corresponding shaped surfaces so that the closure member can slide relative to the dust bowl, preferably between the dust bowl and backing member if present. For example, the parts may comprise flat surfaces, curved surfaces or stepped surfaces. In an especially preferred embodiment the dust collection module, closure member (and dust collection module if present) each comprise a substantially flat first portion. Preferably the dust collection module comprises a second recessed portion integrally formed with its first flat portion. The recessed portion preferably extends above, and/or preferably to the front of the first flat portion in the vacuum cleaner. With this design of dust collection module the closure member preferably comprises a second generally block shaped tubular inlet portion integrally moulded with its first substantially flat portion, and similarly positioned above its first flat portion. It preferably extends into the recessed portion of the dust collection module. Where the closure member can slide relative to the dust collection module, it is preferably arranged to slide from a raised position to a lowered position in which the block shaped inlet of the closure member rests upon and within the recessed portion of the dust collection module. With this arrangement of dust collection module and closure member the shuttle backing member, if present, is preferably similarly provided with a first substantially flat portion, sandwiching the closure member flat portion between itself and the dust collection module first portion. The shuttle backing member is preferably stepped, with a second substantially flat portion extending in the same direction as its first substantially flat portion and connected thereto by a stepped surface extending rearwardly in the vacuum cleaner. With this shape of shuttle backing member, and where the closure member can slide relative to the dust collection module and shuttle backing member, the shuttle member is preferably arranged to slide from a raised position to a lowered position in which the block shaped inlet of the closure member rests upon the stepped surface of the shuttle backing member.

The shuttle backing member is preferably secured to the dust collection module so that relative movement between the two parts is substantially prevented. Securement may be by nuts and bolts, or co-operating screw threaded parts, or by any other means. Preferably securement is such that air inlets in the shuttle backing member and the dust collection module are in register with each other.

The removable dust collection module is preferably bagless.

As described above, in a preferred embodiment of the first aspect of the invention the dust collection module comprises first and second air inlets and the closure member is a shuttle member that can be slid relative to the dust collection module simultaneously to cover the first air inlet and uncover the second air inlet to effect the said closure and opening of the said first and second air flow paths. Similar arrangements in which the closure member is a shuttle member that can be slid relative to one or more other component parts of a vacuum cleaner. i.e. parts other than a dust collection module, in order to change the air flow path are novel per se.

Therefore a second aspect of the present invention provides a kit of parts comprising:

(a) one or more component part(s) of a vacuum cleaner which in use forms part of the air flow path through the vacuum cleaner, the component part(s) comprising first and second air inlets; and (b) a closure member in the form of a shuttle member that can be slid relative to the component part(s) simultaneously to cover the first air inlet and uncover the second air inlet, and vice versa, whereby the air flow path into the component part(s) can be changed.

Preferably the air inlets are in the same component part, but they may instead be provided on different, e.g. adjacent, component parts. The different component parts are preferably spanned by the shuttle member.

Preferred features described above for the first aspect of the present invention also apply to this second aspect of the present invention, as set out, inter alia in the attached claims and preceding text. In particular, it is noted that the shuttle member itself may contain no apertures, one, two or more apertures or other air inlets. Also the movement of the shuttle member relative to the inlets of the component part(s) is preferably the same as the preferred movement of the shuttle member relative to the inlets of the dust collection module described with reference to the first aspect of the present invention. Also it is similarly envisaged with the second aspect of the present invention that three or more inlets and/or apertures may be present in the component part(s) and/or shuttle member in order to achieve three or more alternative air flow paths into the component part(s).

As described above, in a preferred embodiment of the first aspect of the present invention the dust collection module comprises first and second air inlets and the closure member comprises a shuttle member that comprises an opening, and the closure member can be moved relative to the said air inlets so that in a first shuttle position the first, but not the second, air inlet of the component part of the vacuum cleaner is in register with the shuttle opening, and in a second shuttle position the second, but not the first, air inlet of the component part of the vacuum cleaner is in register with the or another shuttle opening. Similar arrangements using this type of shuttle member in combination with other component parts of a vacuum cleaner, i.e. parts other than a dust collection module, are novel per se.

Therefore a third aspect of the present invention provides a kit of parts comprising:

(a) one or more component part(s) of a vacuum cleaner which in use forms part of the air flow path through the vacuum cleaner, the component part(s) comprising first and second air inlets; and (b) a shuttle member comprising one or more apertures, which shuttle member can be moved relative to the said air inlets so that in a first shuttle position the first, but not the second, air inlet of the component part(s) of the vacuum cleaner is in register with the shuttle aperture or one of the shuttle apertures, and in a second shuttle position the second, but not the first, air inlet of the component part(s) of the vacuum cleaner is in register with the or another shuttle aperture.

Preferred features described above for the first and second aspect of the present invention also apply to this third aspect of the present invention, as set out, inter alia in the attached claims and preceding text. In particular, it is noted that the air inlets in the component part(s) may be in a single component part or in different, e.g. adjacent, component parts, and the shuttle member itself may contain one, two or more apertures or other air inlets. Also the movement of the shuttle member relative to the inlets of the component part(s) is preferably the same as the preferred movement of the shuttle member relative to the inlets of the dust collection module described with reference to the first aspect of the present invention. Also it is similarly envisaged with the third aspect of the present invention that three or more inlets and/or apertures may be present in the component part(s) and/or shuttle member in order to achieve three or more alternative air flow paths into the component part(s).

Preferably the shuttle member or other air inlet closure member used in any of the aspects of the invention also operates in conjunction with a latch member that can move from a first position in which, in use, it can engage part of the vacuum cleaner housing, to a second position in which, in use, it is free from the vacuum cleaner housing, the shuttle member or other closure member moving relative to the latch member to cause it to move from its said first to second position. With this embodiment the shuttle member or other closure member has a dual function; it is a means of modifying the air flow path into a dust collection module or other vacuum component part, and it is a release member for the latch.

Preferably the latch member is retained to the dust collection module or other component part so that relative movement in at least one direction (e.g. upwards) is restricted, preferably substantially prevented. For example, the latch member can be used to secure itself (and the dust collection module or other vacuum component part) to the vacuum cleaner housing when the shuttle member is moved, e.g. raised relative to the dust collection module or other vacuum component part.

In a preferred embodiment according to the first, second and third aspect of the present invention, the kit of parts also includes a hose attachment part. Preferably the closure member of the kit of parts according to the first, second or third aspect of the invention comprises a tubular air inlet and the hose attachment part is a snap fit attachment into (or around) the tubular air inlet of the said closure member. This snap fit hose attachment to a tubular inlet part is novel per se.

Accordingly a fourth aspect of the present invention provides a kit of parts comprising a hose connector and a component part of a vacuum cleaner with two air inlets, a second of the inlets of the component part being adapted to receive the hose connector in a detachable snap-fit. To this end the hose attachment part and the tubular inlet preferably have correspondingly shaped mating parts, so that one part preferably fits within the other part.

Preferably the hose connector is provided with one or more tines that are a snap fit within (or around) the inlet of the component part. In one embodiment the inlet of the component part is tubular and the tine(s) are a snap fit against (or around) an inner (or outer) surface of the tubular inlet. As an example both the tubular inlet of the component part and the hose attachment may have tubular parts of rectangular cross-section, with one fitting inside the other.

The two tines on the hose are preferably provided on opposite sides of the hose attachment, and the tines are preferably a snap fit within and against (or around) opposite inner (or outer) side surfaces of the tubular inlet of the component part. Where the hose attachment and inlet of the component part are rectangular, the tines are preferably provided on the short sides of the tubular hose attachment.

Preferably the tine(s) are pivotal, and pivot about a point or line.

Preferably the component part with air inlets to which the hose attachment is attached is the closure member (e.g. shuttle member) according to the first, second or third aspect of the present invention.

The present invention also provides a vacuum cleaner including a kit of parts according to any previously described aspect of the present invention. The vacuum cleaner is preferably bagless. The vacuum cleaner preferably comprises a floor travelling head including the parts of each of the kits of parts described with reference to the first, second, third and fourth aspect of the present invention. The vacuum cleaner may or may not comprise a handle for upright use. The vacuum cleaner may be battery or mains powered. Typically the vacuum cleaner will also contain one or more of the motor, an impeller, and a filter.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Embodiments of the present invention will now be described, with reference to the accompanying drawings, wherein:

FIG. 9 is a perspective view of the vacuum cleaner of FIG. 1, without its handle, and with a hose attachment part attached; and The present invention will become more fully understood from the detailed description and the accompanying drawings, wherein:

DETAILED DESCRIPTION OF THE PREFERRED EMBODIMENTS

Figure 1A:
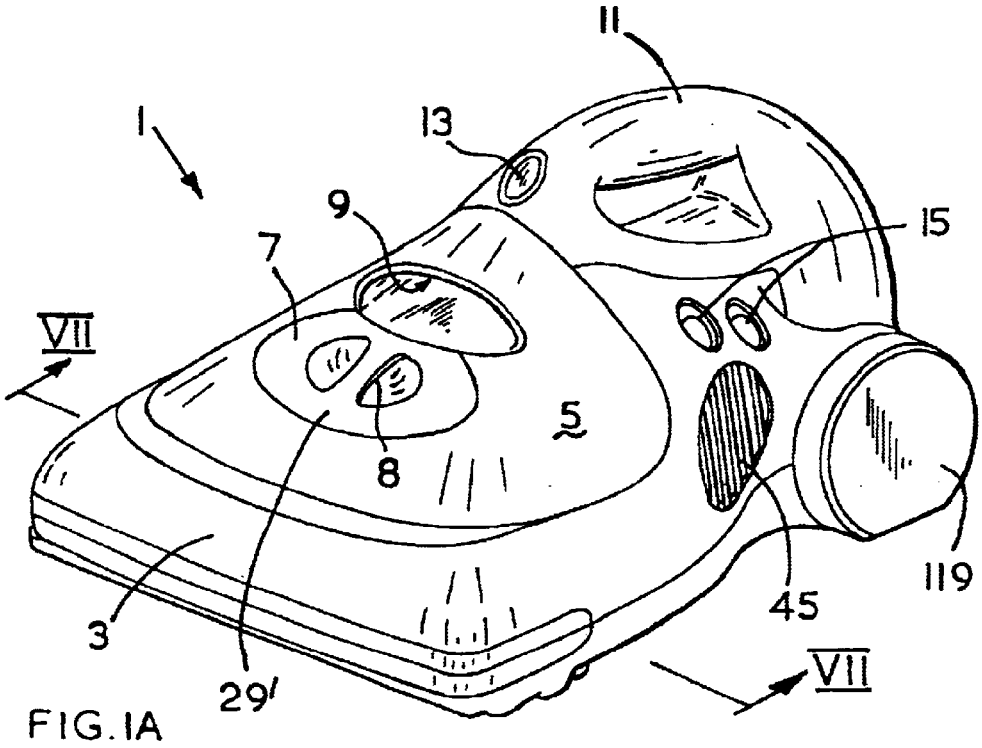
FIGS. 1A and 1B are perspective views of a vacuum cleaner according to the present invention showing the shuttle member in lowered and raised position respectively.
Figure 1B:
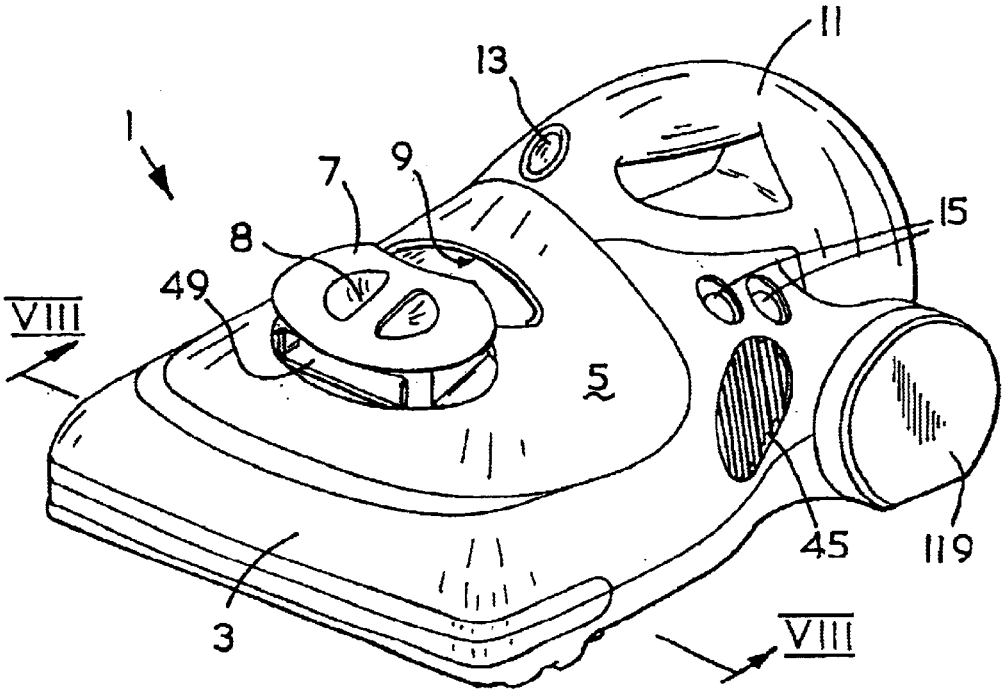

Referring to the drawings, FIGS. 1A and 1B show a vacuum cleaner 1 comprising a main housing portion 3 containing a dust bowl 5, and a shuttle member 7, shown in its lowered position in FIG. 1A for floor suction use, and in its raised position in FIG. 1B for hose attachment. In its raised position (FIG. 1B) a tubular inlet 49 of shuttle member 7 is visible.

In order to facilitate movement of the shuttle member 7 from its lowered to raised position, integrally shaped finger depression handles 8 are formed in the upper surface of the shuttle member 7. The action of the shuttle member to change the air flow path into the dust bowl 5 for floor or hose attachment use is described in more detail below with reference to FIGS. 3 to 8

The vacuum cleaner 1 is bagless, with dust being collected directly in dust bowl 5. The dust bowl needs to be emptied regularly and is therefore removable from the main housing portion 3. To this end, the dust bowl 5 contains an integrally formed recessed handle 9 on its upper surface that can be gripped and pulled upwards to remove the dust bowl. A lockable latching mechanism is provided to prevent accidental removal of the dust bowl 5 when the shuttle member 7 is raised for hose attachment. This is described in more detail below with reference to FIGS. 7 and 8.

The vacuum cleaner 1 as shown in FIGS. 1A and 1B also includes a handle 11 detachably secured to the main housing portion 3 by depressible spring biased buttons 13 and 15 in a known manner. As shown the cleaner is suitable for hand-propelled use over a floor or surface. If desired the detachable handle 11 can be replaced by a long handle to convert the vacuum cleaner to upright use.

The vacuum cleaner shown is powered by rechargeable batteries, and a rechargeable mount for electrical connection to a mains charging supply is provided under the removable cap 119, which may be a screw or push fit attachment. It is also envisaged that the vacuum cleaner could be mains powered.

The vacuum cleaner housing portion 3 also contains side vents 45 for air outlet, as described in more detail with reference to FIG. 2.

Housing and handle parts 3 and 11, dust bowl 5 and shuttle member 7 preferably each comprise moulded polymeric material.

Figure 2:
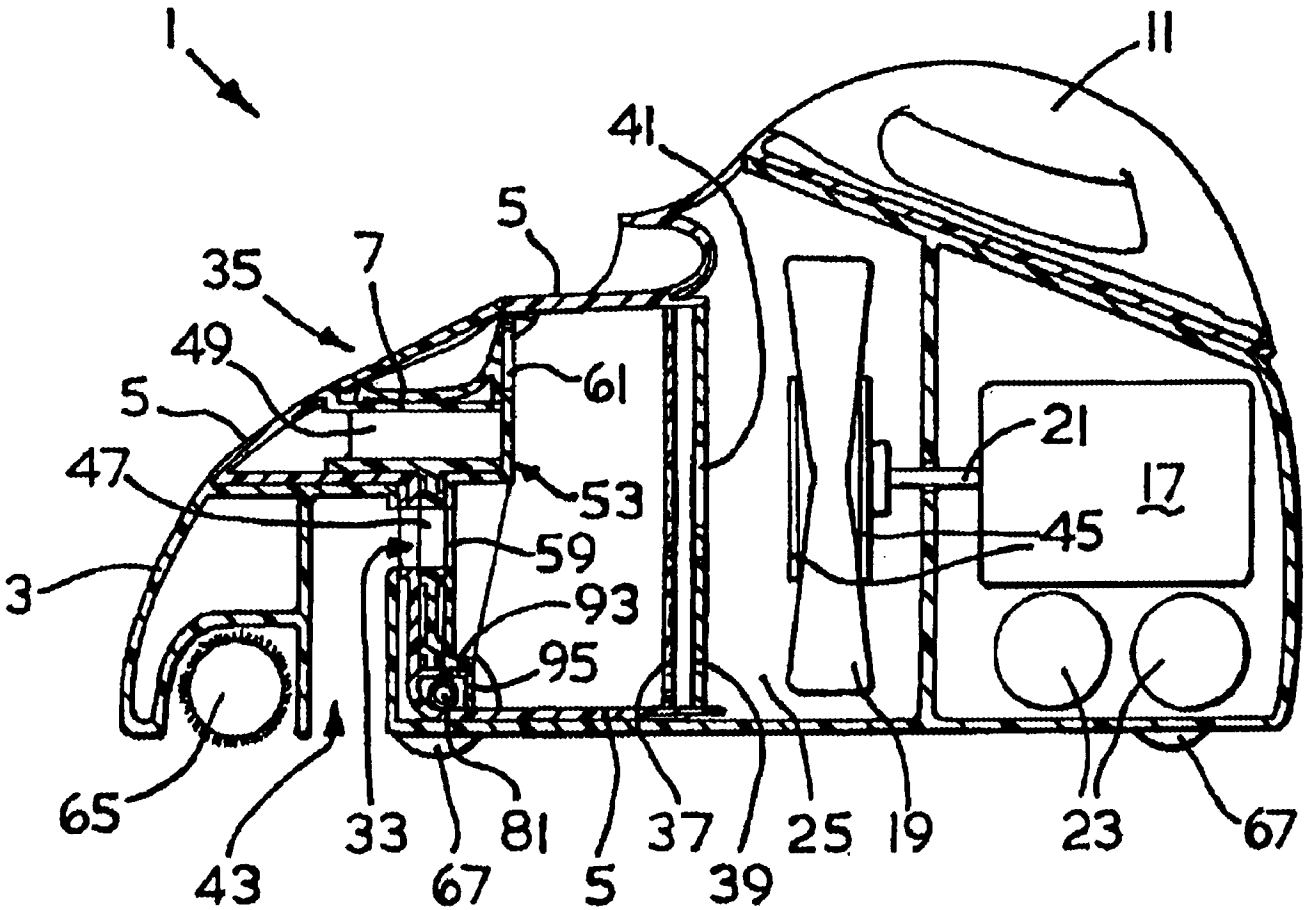
FIG. 2 is a longitudinal sectional view through the vacuum cleaner of FIG. 1A.

Further features of the vacuum cleaner are evident from the longitudinal sectional view of FIG. 2 in which the shuttle member 7 is shown in its lowered position corresponding to the arrangement shown in FIG. 1A.

From FIG. 2 it can be seen that the main housing portion 3 of the vacuum cleaner comprises a motor 17 driving an impeller or fan 19 via a drive shaft 21. The motor is adjacent to and electrically connected to rechargeable batteries 23. Two are visible in the section of FIG. 2, but there would usually be four or six batteries. The fan 19 is located in a fan chamber 25, that is located immediately behind the dust collection bowl 5. Air vents 45 are provided on the side surfaces of the fan chamber 25 (see also FIG. 1A and 1B).

The dust collection bowl is generally cup shaped. It contains two air inlets 33, 35 in a common face, i.e. the front face, of the dust bowl 5. Shuttle member 7 is located within the dust bowl 5, and lies against part of the inner surface of the front face of the dust bowl 5. A shuttle backing plate 53, which is secured to the dust bowl 5, sandwiches the shuttle member 7 between it and the inner surface of the front face of the dust bowl 5, thereby providing a channel within which the shuttle member 7 can slide relative to the dust bowl 5. Shuttle member 7 and shuttle backing plate 53 also each comprise two air inlets; shuttle member 7 comprising inlets 47 and 49, and shuttle backing plate 53 comprising inlets 59 and 61. In the position shown in FIG. 2 air inlet 33 in the dust bowl 5 is in register with the air inlet 47 in shuttle member 7 and with air inlet 59 into the backing plate 53, but inlet 35 into dust bowl 5 is blocked by part of the shuttle member 7. The movement of the shuttle member relative to the dust bowl 5 and shuttle backing plate 53 to alter the air flow path into the dust bowl are described in more detail with reference to FIGS. 3 and 4.

The rear face of the dust bowl 5 is covered by a filter member 37 and a back cover plate 39 spaced therefrom, and containing an air outlet 41. The bottom surface of the vacuum cleaner comprises an air inlet 43, which is in communication with the first air inlet 33 into the dust bowl 5.

In operation, in the shuttle position shown in FIG. 2, the motor 17 drives fan 19 causing air and dust, dirt or debris to be sucked into the suction inlet 43 on the bottom surface of the vacuum cleaner. The air and entrained dust, dirt or debris travel via the inlet 43, through the first inlet 33 of the dust bowl, the aperture 47 in the shuttle 7, and the aperture 59 in the shuttle backing plate 53 and into the dust bowl 5. The large size of the receiving area of the dust bowl causes air velocity in the dust bowl to be smaller than at the entrance 33. This allows the entrained dirt, dust and debris to fall into the dust bowl 5. Air then travels through the filter 37 and the opening 41 in the back cover 39 of the dust bowl 5, and is pushed by the fan 19 out of the housing 3 via the vents 45 in the side surfaces of the housing.

FIG. 2 also shows a latch member 81 (shown end-on in FIG. 2) which rests on the bottom of the dust bowl 5, and operates with the shuttle member 7 to provide a releasable latch member to hold the dust bowl 5 in the housing when the shuttle member 7 is raised. This is described in more detail below, with reference especially to FIGS. 7 and 8.

The vacuum cleaner also has a front brush 65 which may be separately powered (powering means not shown), and which is surrounded by housing portions so as to separate it from the front air inlet 43 into the vacuum cleaner, thereby ensuring that suction power is not reduced. Wheels 67 are also provided on the lower surface of the vacuum cleaner.

Figure 3:
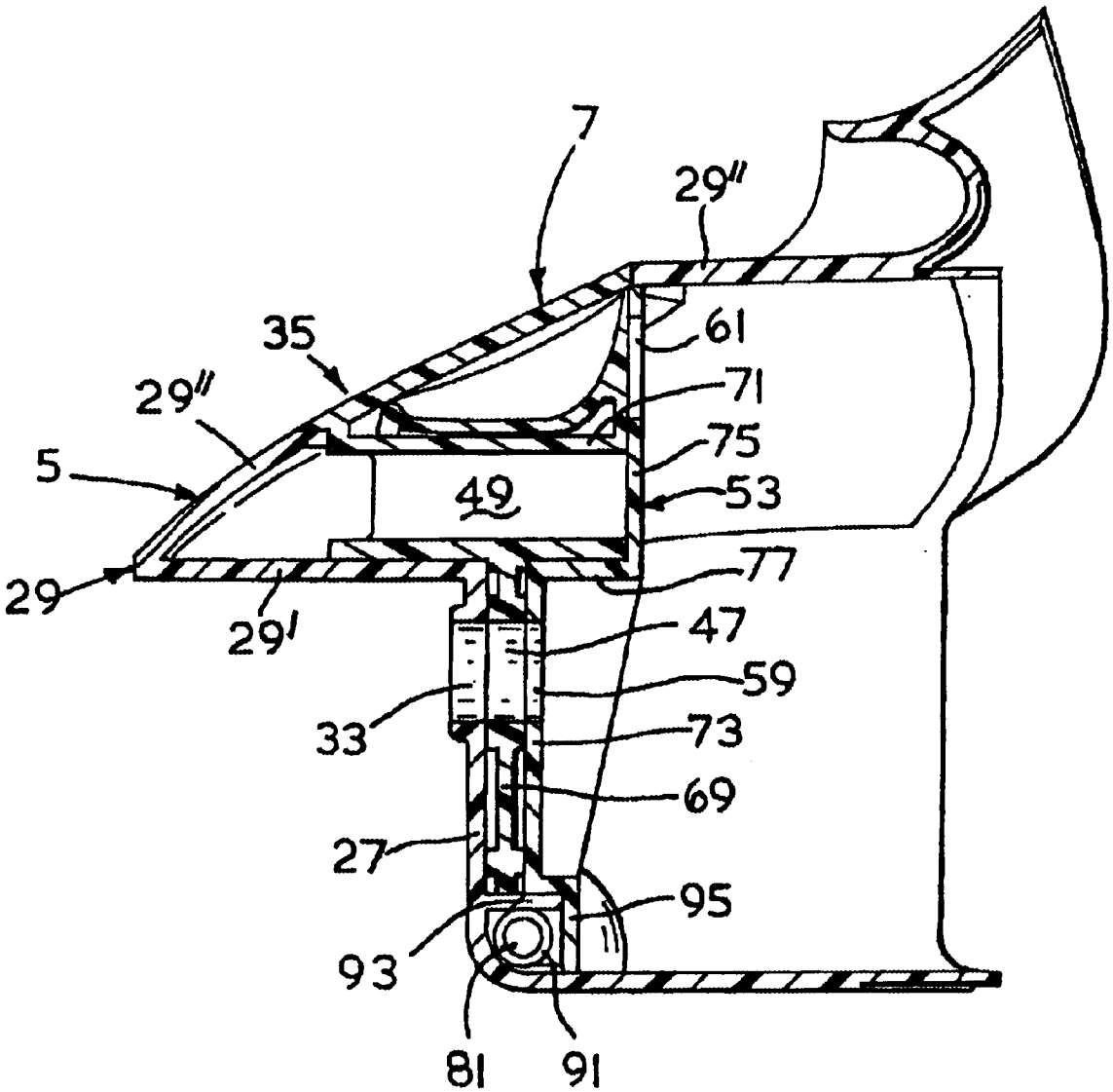
FIG. 3 is an enlarged longitudinal sectional view through the dust bowl and shuttle member only of the vacuum cleaner of FIG. 1.
Figure 4:
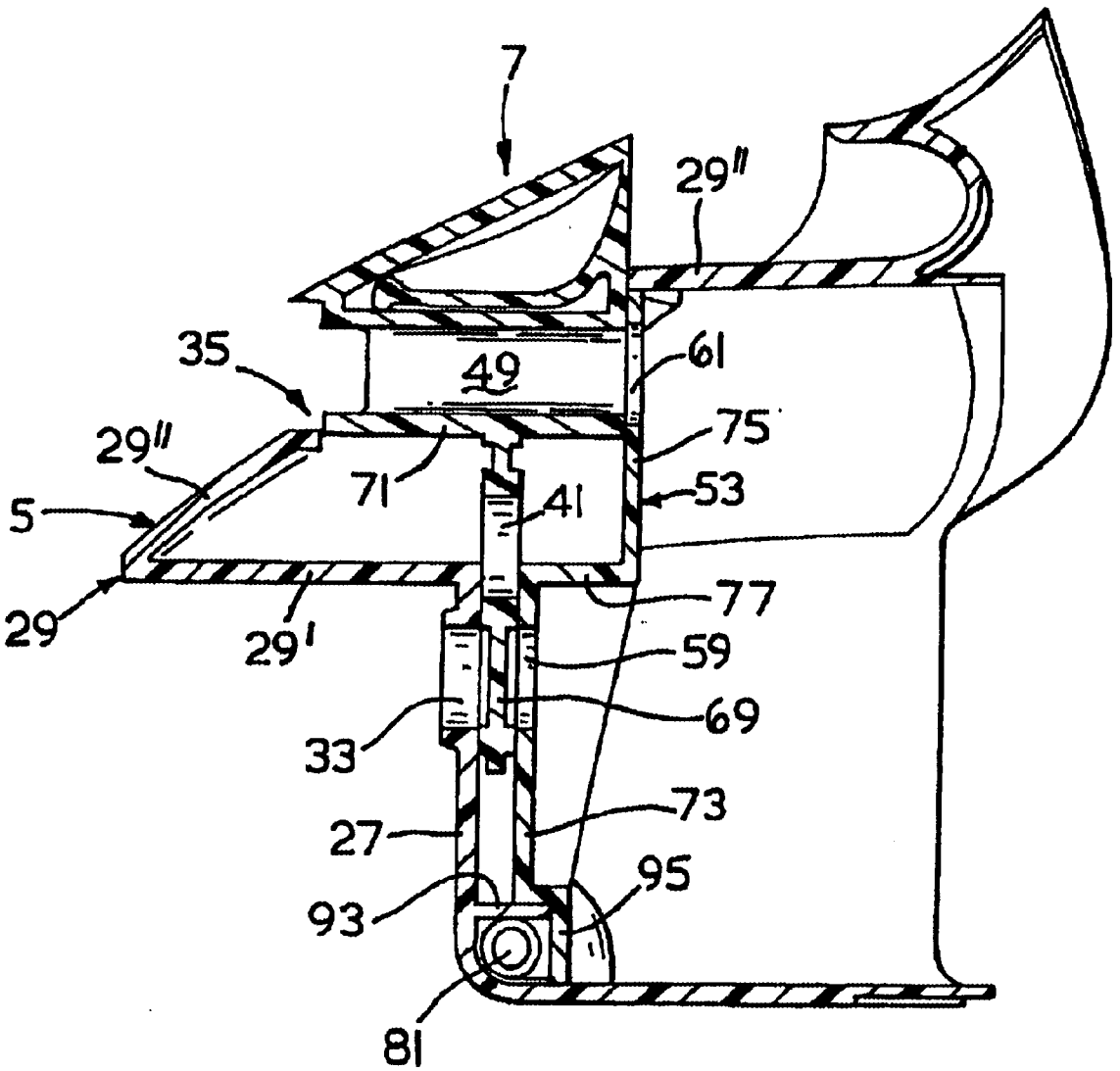
FIG. 4 is an enlarged longitudinal sectional view through the dust bowl and shuttle member only of the vacuum cleaner of FIG. 1.

Turning now to FIGS. 3 to 6, these Figures show in more detail the features of the dust bowl 5 and the shuttle member 7 and backing plate 53, and show the change in air flow into the dust bowl 5 achieved by movement of the shuttle member 7 relative to the dust bowl 5. For simplicity FIGS. 3 and 4 show only the dust bowl 5, shuttle member 7 and backing plate 53 and do not show the filter 39 or back cover plate 41 of the dust bowl 7 or other features of the vacuum cleaner.

Figure 5:
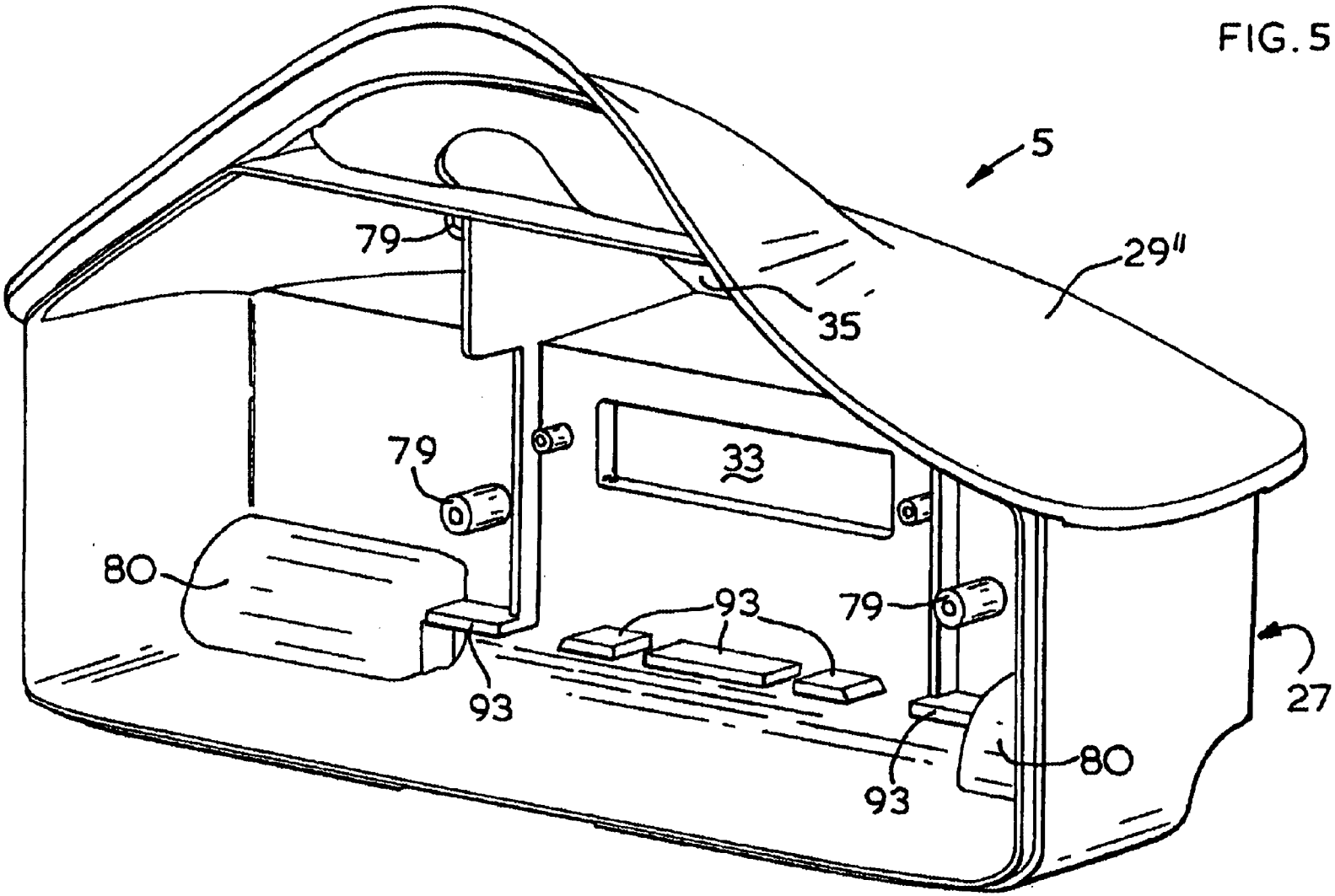
FIGS. 5 and 6 are perspective views of the dust bowl and shuttle member components shown in FIGS. 3 and 4.

Referring first to FIGS. 3, 4, and 5, the dust bowl 5 has a front face (facing into the page in FIG. 5) that comprises a first substantially flat faced portion 27 that extends substantially vertically upwards from the lower surface of the main housing portion 3, and a second recessed portion 29 extending from the first portion 27 first to the front of the vacuum cleaner (reference 29'), and then rearwards in a curved shape (reference 29") to form part of the upper surface of the vacuum cleaner (see also FIGS. 1A). The front face 27, 29 of the dust bowl contains two apertures for air; a first aperture 33 which is in the first flat faced portion 27 of the front face of the dust bowl, and a second inlet 35 which is in the second recessed portion 29" of the front face of the dust bowl 5.

FIG. 5 also shows that the dust bowl 5 comprises bolts 79 which can be used to engage the backing plate 53, as mentioned above. It also shows wheel recesses 80 that make space for the wheels 67 of the vacuum cleaner (FIG. 2). It also illustrates inwardly directed ridges or flanges 93 which are provided in five separate parts and are used to prevent upward movement of the latch member 81 mentioned above in the description of FIG. 2 and described in more detail below with reference to FIGS. 3 and 4 and 7 and 8.

Figure 6:
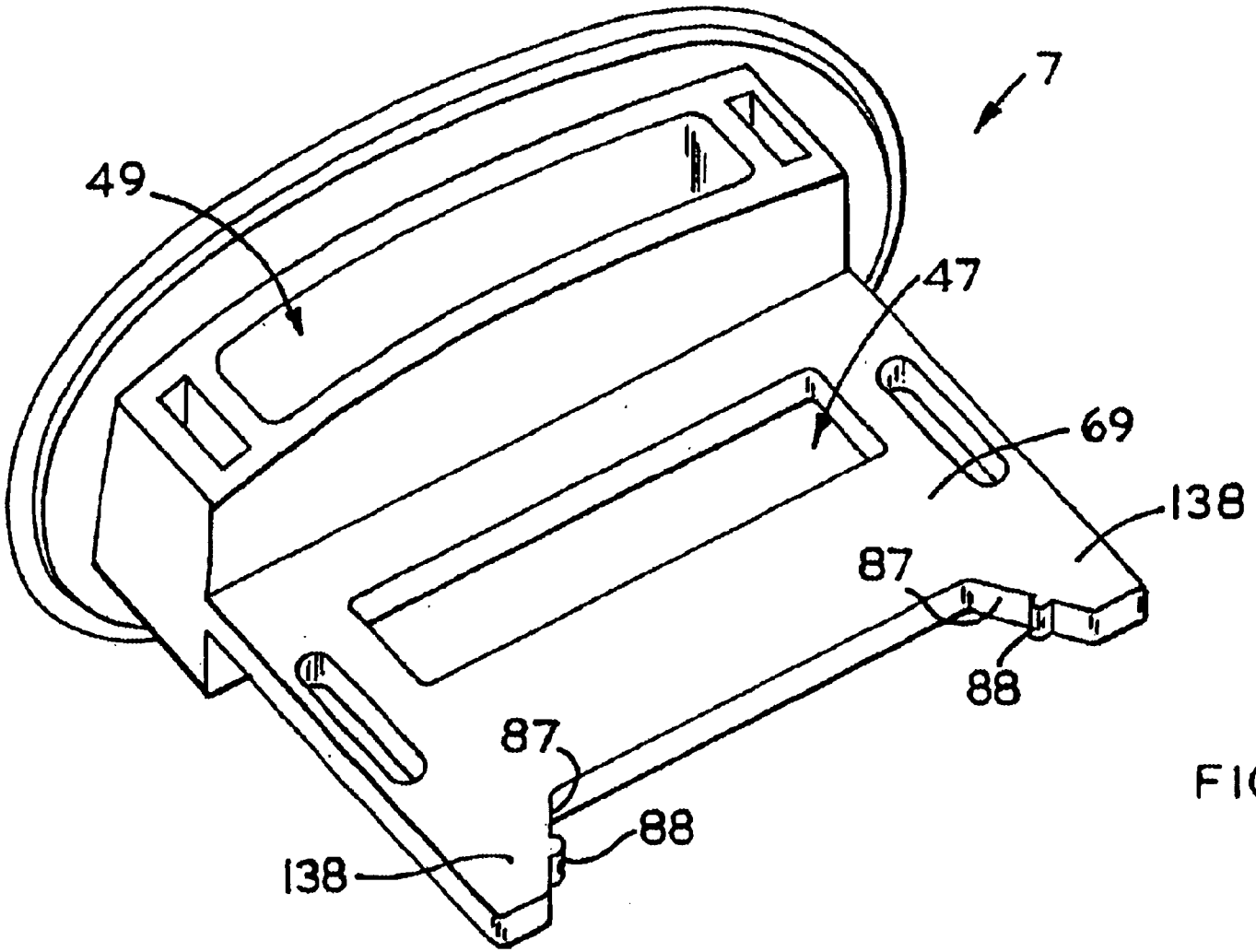

Referring to FIGS. 3, 4, and 6, it can be seen that the shuttle member 7 comprises a first lower, substantially flat portion 69 integrally moulded with a second upper block shaped portion 71. In common with the dust bowl 5, the shuttle member 7 also contains two air inlets; a first inlet in the form of a slot shaped aperture 47 in the first substantially flat portion 69 of the shuttle member 7, and a second air inlet in the form of a tubular inlet 49 of generally rectangular cross section through the block shaped portion 71 of the shuttle member. As best seen by comparing FIG. 1 and FIG. 6, the uppermost surface of the shuttle member 7 is slightly curved to form the contoured outer surface of the vacuum cleaner.

As seen in FIG. 6, the lower surface of its flat portion 69 is provided with inwardly facing cam surface 87, and each cam surface 87 is provided with a metallic ball bearing or strip bearing 88. These cam surfaces and bearings act to engage the latch member 81 as described below with reference to FIGS. 7 and 8.

Referring again to FIGS. 3 and 4, backing plate 53 comprises a stepped backing surface, comprising first and second substantially flat portions 73, 75 extending substantially parallel to each other and to the first portions 27 and 69 of the dust bowl 5 and shuttle member 7 respectively, and a stepped portion 77 connecting the first and second portions 73, 75 of the backing plate 53. The backing plate 53 also comprises two apertures 59, 61 in the first and second portions 73, 75 respectively. Backing plate 53 is secured to the inner surface of the dust bowl 5 by means of attachment nuts (not shown) which secure to moulded bolts 79 projecting inwardly of the dust bowl 5 (see FIG. 5). The arrangement is such that the aperture 33 in the dust bowl 5 is always in register with the aperture 59 in the backing plate 53, and such that the inlet 35 in the dust bowl 5 is always in register with the aperture 61 in the backing plate 53.

The operation of the shuttle member to alter the air flow through the vacuum cleaner is now described. In FIG. 3 the shuttle member 7 is shown in its lowered position, for floor cleaning, and in FIG. 4 the shuttle member 7 is shown in raised position for hose attachment.

In the position shown in FIG. 3, air inlet 33 into the dust bowl 5 (and hence also the aperture 59 in the backing plate) is in register with aperture 47 of the shuttle 7, but the air inlet 35 into the dust bowl (and also the aperture 61 through the backing plate 53) is covered and blocked by part of the shuttle member 7. Hence referring also to FIG. 2 operation of the motor and fan causes air to be drawn through the in register apertures into the dust bowl, i.e. through the floor inlet 43.

In contrast, in the position shown in FIG. 4, air inlet 35 into the dust bowl 5 (and hence also the aperture 61 into the backing plate 53 is in register with the tubular inlet 49 through the shuttle member 7, but the air inlet 33 into the dust bowl (and also the aperture 59 into the backing plate 53) are covered by part of the flat surface 27 of the shuttle member 7. Thus in this case operation of the motor and fan causes air to be drawn through the in-register inlets, i.e. through the aperture 49 on the upper surface of the vacuum cleaner. As described below with reference to FIG. 9 and 10 a hose attachment is connected in this position to the tubular inlet 49 of the shuttle member 7.

Thus a simple design is provided for changing the air flow path through the vacuum cleaner from one where suction is from a floor directed inlet to one where suction is through a hose attachment inlet on an upper surface of the vacuum cleaner. It will be appreciated that the fact that only one air flow path is open at any one time ensures that suction power of the vacuum cleaner is not diminished in either position.

FIGS. 3 and 4 also illustrate in cross-section the latch member 81 (shown end-on in FIGS. 3 and 4), which as mentioned above can be used, in combination with the shuttle member 7 which acts to lock or release the latch member 81, to secure the dust bowl 5 to the main housing portion 3 when the shuttle 7 is raised, thereby preventing accidental removal of the dust bowl when the shuttle 7 is raised. The latch member 81 is substantially prevented from moving upwards or downwards relative to the dust bowl 5 by means of the lower surface of the dust bowl 5 on which it rests, and the inwardly directed retaining flanges 93 projecting from the front surface of flat portion 27 of the dust bowl just above the latch member 81, and previously mentioned in the description of FIG. 5. The latch member 81 is substantially prevented from moving into the body of the dust bowl 5 by a part 95 of the backing pate 53.

Figure 7:
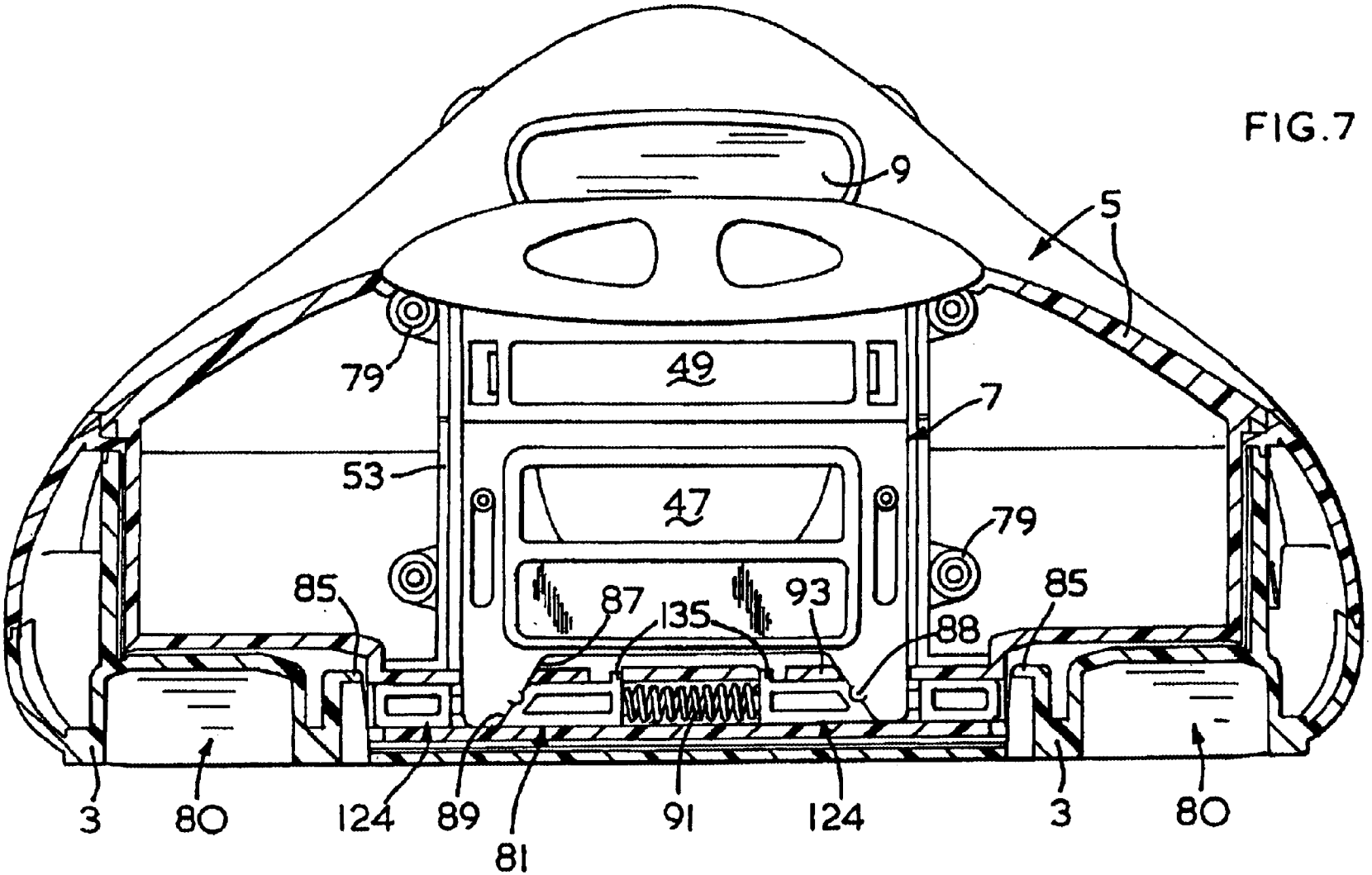
FIG. 7 is a cross-sectional view through the vacuum cleaner of FIG. 1A, taken along the line VII—VII of FIG. 1A, as viewed from the front of the vacuum cleaner.
Figure 8:
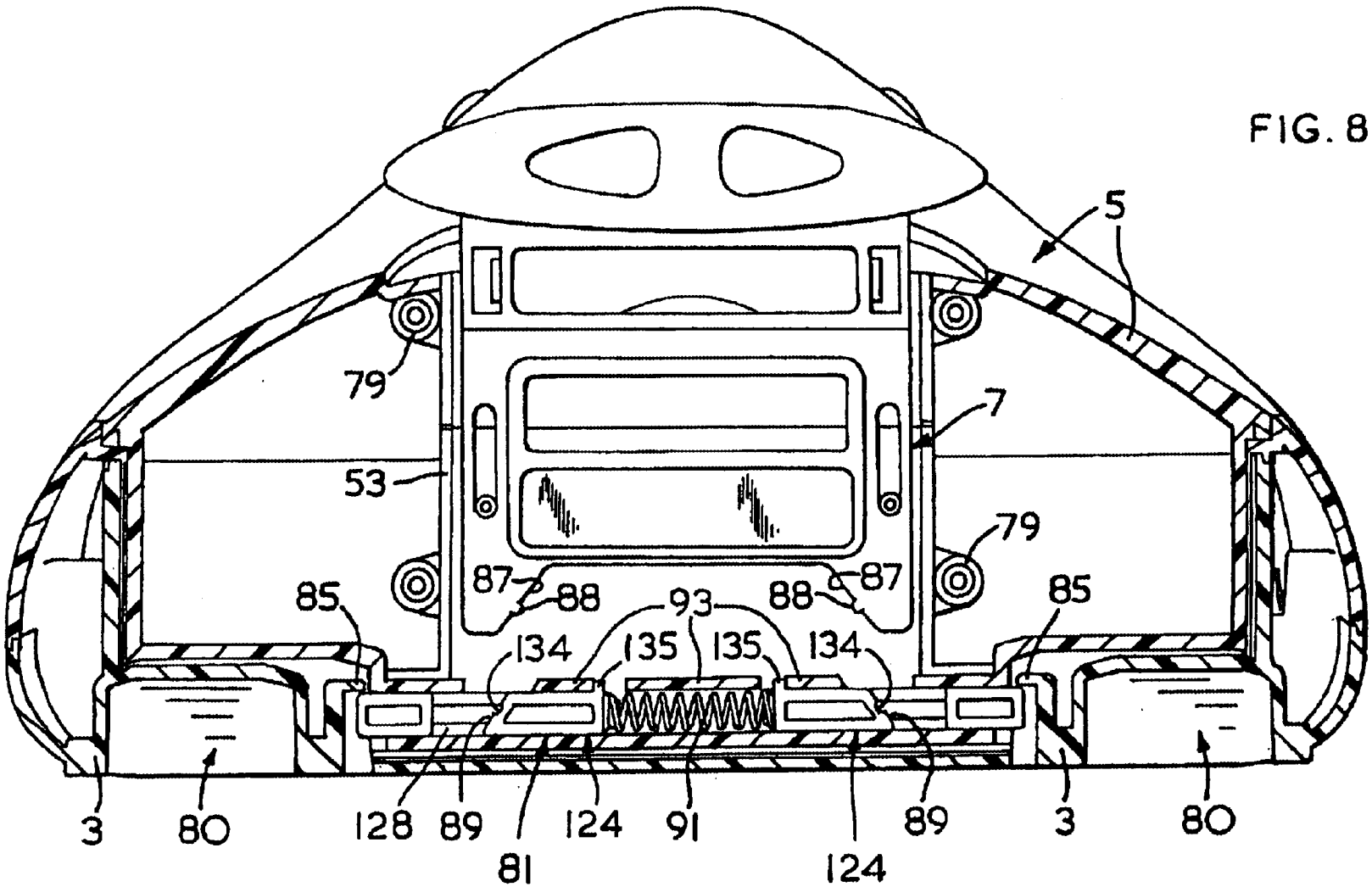
FIG. 8 is a cross-sectional view through the vacuum cleaner of FIG. 1*b*, taken along the line VIII—VIII of FIG. 1B, as viewed from the front of the vacuum cleaner.

FIGS. 7 and 8 show the operation of the elongate spring biased latch member 81 in more detail. These Figures are cross-sectional views of the vacuum cleaner, taken through the shuttle member 7, as viewed from the front of the vacuum cleaner, showing the shuttle in lowered (FIG. 7) and raised (FIG. 8) position. The latch member 81 comprises two end housing-engagement portions 124 joined by a compressible helical spring 91. Each end housing-engagement portion 124 includes a cam surface 89 in a recessed section 128 part way along its length. The inner ends of each housing engagement portion 124 is provided with an upwardly directed flange 135. As can be seen by comparison of FIGS. 7 and 8, when the shuttle member 7 is lowered the end housing-engagement portions 124 of the spring biased latch member 81 are caused to move towards each other, (i.e. the elongate latch member shortens in length) by the action of co-operating cam surfaces 87 and 89 on the shuttle member 7 and latch member 81 respectively. Inward movement of the end housing-engagement portions 124 of the latch member 81 is limited by the upwardly directed flanges 135 on the inner side of the end housing-engagement portions 124 which abut against the inner edge of the space between the separate parts of the restraining ridges or flanges 93 projecting from the dust bowl 5. This shortening in length acts against the biasing force of a spring member 91 forming the central part of the latch member 81.

When the shuttle member 7 is raised again, and the cam surfaces 87 and 89 are separated, the spring 91 acts to revert the latch member to its previous longer length. In this case outward movement of the end housing-engagement portions 124 of the latch member 81 is limited by the upwardly directed flanges 135 on the inner side of the end housing-engagement portions 124 which abut against the outer edge of the space between the separate parts of the restraining ridges or flanges 93 projecting from the dust bowl 5. In this position the latch member 81 engages beneath a retaining projection 85 on the main housing portion 3. Thus the latch member 81 moves from a first (unlocked) position in which it does not engage a retaining projection 85 on the main housing portion 3, to a second (locked) position where it does engage the retaining projection 85 on the main housing portion 3. Thus by moving the shuttle from its lowered position (FIG. 7) to its raised position (FIG. 8) the latch member moves from an unlocked to a locked position. As already described the latch member's movement relative to the dust bowl 5 is restricted by means of the bottom of the dust bowl 5, flanges 93 directed inwardly from the front face of the dust bowl 5, and a back flange 95 forming part of the shuttle backing plate 53 (see FIGS. 3, 4, and 5). Therefore by moving the shuttle from its lowered position (FIG. 7) to its raised position (FIG. 8) the latch member moves from a position in which the dust bowl is not locked in place relative to the housing portion 3 of the vacuum cleaner to a position in which it is locked in place relative to the housing portion 3 of the vacuum cleaner. Thus when the shuttle member 7 is raised for hose attachment use, the dust bowl 5 is locked in position relative to the vacuum cleaner housing, and there is no risk of accidental dust bowl lifting occurring during the hose attachment process.

Metal bearing strips 88 on the cam surfaces 87 of the shuttle member, and co-operating grooves 134 in the latch member cam surface are provided to form friction engagement between the cam surfaces 87 and 89, which must be overcome by the operator to lift the shuttle member 7. However, when the shuttle member 7 is lowered, dust bowl removal (for emptying) is possible. The latch member 81, and its co-operation with the shuttle member 7 to form a locking mechanism for the dust bowl 5 forms the subject of contemporaneously filed British Patent Application titled "Locking Mechanism for Dust Collection Module of Vacuum Cleaner" (sharing filing date of this Application, G8 01-165-88.5,pending filed by common applicant, the entire disclosure of which is incorporated herein by reference.

Therefore a simple design is provided whereby the shuttle release member 7 acts not only as a means of changing the air flow part into and through the vacuum cleaner, from one where suction is from a floor directed inlet to one where suction is through a hose attachment inlet on an upper surface of the vacuum cleaner, but also as a means of detachably retaining the dust bowl 5 relative to the housing portion 3, and the arrangement is such that dust bowl removal does not accidentally occur when the shuttle member is raised for hose attachment.

Figure 9:
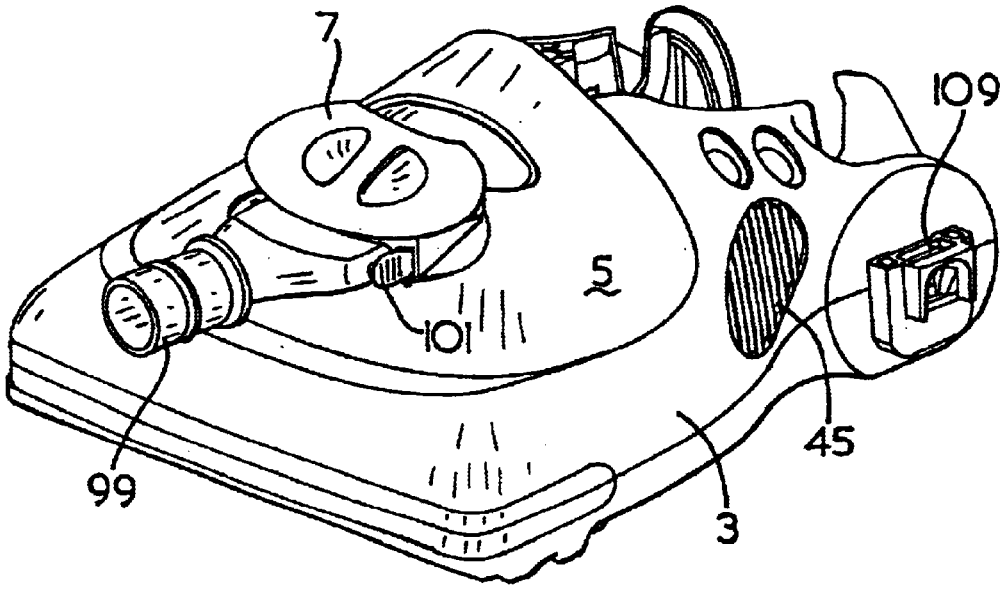
Figure 10:
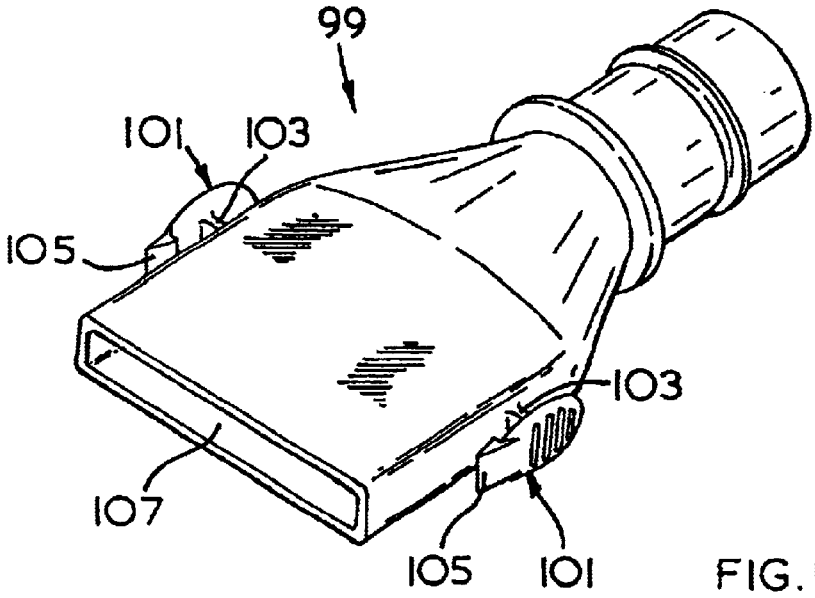
FIG. 10 is a perspective view of the hose attachment part of FIG. 9, prior to attachment.

FIG. 9 shows the vacuum cleaner of FIG. 1B with the shuttle member 7 in raised position and with a hose attachment 99 attached to the tubular inlet 49 into the shuttle member 7. FIG. 10 shows the hose attachment piece 99 in an unattached position.

Referring to FIGS. 9 and 10 it can be seen that the end of the hose attachment 99 has a rectangular cross-sectioned tubular inlet 107 that can be slid into the rectangular tubular inlet 49 of the shuttle member 7. Two pivotal attachment tines 101 are provided, one on opposite outer short sides of the hose attachment 99. Each tine 101 pivots about a ridge line 103, so that its inwardly directed end 105 can be depressed and slid into the tubular inlet 49. By this action it is a snap fit against the inner short side walls of the tubular inlet 49 of the shuttle member 7.

FIG. 9 also shows the socket 109 for mounting a battery recharging unit for recharging the batteries 23 in the vacuum cleaner. This unit 109 was hidden from view by cap 19 in FIGS. 1A and 1B.

What is claimed is:

1. A vacuum cleaner comprising:

a removable dust collection module which forms part of an air flow path through the vacuum cleaner; and a closure member arranged to be moved relative to the collection module so as simultaneously to close a first air flow path into the dust collection module and to open a second air flow path into the dust collection module that is remote from the first dust flow path, and vice versa.

2. The vacuum cleaner of claim 1, wherein the dust collection module comprises first and second air inlets, and movement of the closure member acts simultaneously to cover the first air inlet and to uncover the second air inlet and vice versa, thereby simultaneously closing the first air flow path into the dust collection module and opening the second air flow path into the dust collection module, and vice versa.

3. The vacuum cleaner of claim 1, wherein the dust collection module comprises first and second air inlets that are on a common surface of the dust collection module.

4. The vacuum cleaner of claim 3, wherein the closure member comprises a shuttle member that can be slid relative to the dust collection module simultaneously to cover the first air inlet and uncover the second air inlet, and vice versa.

5. The vacuum cleaner of claim 1, wherein:

the dust collection module comprises first and second air inlets;

the closure member comprises a shuttle member that comprises first and second openings the closure member can be moved relative to said air inlets so that in a first shuttle position the first, but not the second, air inlet of the dust collection module of the vacuum cleaner registers with the first opening; and in a second shuttle position the second, but not the first, air inlet of the dust collection module registers with the second opening.

6. The vacuum cleaner of claim 5, wherein the closure member is moved relative to said air inlets so that in a first shuttle position the first air inlet of the dust collection module of the vacuum cleaner registers with the first opening but the second air inlet of the dust collection module is not in register with the second opening, and in a second shuttle position the second air inlet of the dust collection module of the vacuum cleaner registers with the second opening, but the first air inlet of the dust collection module is not in register with the first opening.

7. The vacuum cleaner of claim 6, wherein at least one of the openings comprises an aperture.

8. The vacuum cleaner of claim 1, wherein the closure member is at least partly contained within the dust collection module.

9. The vacuum cleaner of claim 1, wherein the closure member has a surface that corresponds in shape to at least part of an inwardly facing surface of the dust collection module.

10. The vacuum cleaner of claim 1, wherein the dust collection module comprises a pair of air inlets, and the closure member is located adjacent an inlet-containing surface of the dust collection module.

11. The vacuum cleaner of claim 1, wherein the closure member is in contact with the inlet containing surface throughout its movement relative to the dust collection module.

12. The vacuum cleaner of claim 1, further comprising a backing plate positioned to locate the closure member between the backing plate and the dust collection module.

13. The vacuum cleaner of claim 12, wherein the backing plate is positioned to provide a channel between itself and a surface of the dust collection module, in which said channel the closure member can slide.

14. For a vacuum cleaner, a dust collection module which in use forms part of an air flow path through the vacuum cleaner, the dust collection module component part(s) comprising:

first and second air inlets; and a closure member in the form of a shuttle member that can be slid to the component part(s) simultaneously to cover the first air inlet and uncover the second air inlet, and vice versa, whereby the air flow path into the component part(s) can be changed.

15. The dust collection module of claim 14, wherein the air inlets are disposed in a common surface of the dust collection module.

16. The dust collection module of claim 14, wherein the closure member comprises a shuttle member having first and second openings, and the closure member can be moved relative to said air inlets so that in a first shuttle position the first, but not the second, air inlet is in register with the first opening, and in a second shuttle position the second, but not the first, air inlet is in register with the second opening.

17. The dust collection module of claim 16, wherein one of said first and second openings comprises one of an aperture and a tubular inlet.

18. The dust collection module of claim 14, wherein the closure member has a surface that corresponds in shape to at least part of an inwardly facing surface of the module.

19. The dust collection module of claim 14, wherein the closure member is located adjacent an inlet containing surface of the module.

20. The dust collection module of claim 19, wherein the closure member is located adjacent an inwardly facing surface of the said inlet containing.

21. The dust collection module of claim 20, wherein the closure member is in contact with, and remains in contact with, the inlet containing surface throughout its movement.

22. The dust collection module of claim 21, comprising a backing plate positioned to locate the closure member between itself and the module.

23. The dust collection module of claim 22, wherein the backing plate is positioned to provide a channel between itself and a surface of the module, in which channel the closure member can slide.

24. The dust collection module of claim 23, wherein the closure member has a surface that corresponds in shape to at least part of an opposed surface of the backing plate.

25. A vacuum cleaner comprising:

a dust collection component which in use forms part of an airflow path through the vacuum cleaner, the component including first and second air inlets;

a shuttle member supported by said dust collection component, said shuttle member comprising at least one aperture and an airflow blocking portion, said shuttle member being movable slidably relative to said dust collection component;

said shuttle member being movable from a first position, wherein said aperture is in airflow communication with said first air inlet and said airflow blocking portion blocks said second inlet, to a second position wherein said aperture is not in airflow communication with said first air inlet and said airflow blocking portion is not blocking said second inlet.

26. A vacuum cleaner comprising:

a dust collection component which in use forms part of an airflow path through the vacuum cleaner, the component including spaced apart first and second air inlets;

a shuttle member supported for slidable movement relative to said dust collection component, said shuttle member including first and second spaced apart openings and first and second airflow blocking portions;

said shuttle being movable from a first position wherein said first opening communicates with said first air inlet and said second airflow blocking portion blocks said second air inlet, to a second position wherein said second opening communicates with said second air inlet and said first airflow blocking portion blocks said first air inlet.

27. A vacuum cleaner comprising:

a dust collection component which in use forms part of an airflow path through the vacuum cleaner;

a shuttle member movable slidably generally linearly relative to said dust collection component;

said shuttle member providing a first airflow path for dirt entrained air into said dust collection component when said shuttle is in a first position; and said shuttle member providing a second airflow path for dirt entrained air into said dust collection component when said shuttle is moved into a second position.

28. The vacuum cleaner of claim 27, wherein said shuttle member blocks said second airflow path when said shuttle member is providing said first airflow path.

29. The vacuum cleaner of claim 27, wherein said shuttle member blocks said first airflow path when said shuttle member is providing said second airflow path.

* * * * *

UNITED STATES PATENT AND TRADEMARK OFFICE

CERTIFICATE OF CORRECTION

PATENT NO. : 6,785,932 B2
APPLICATION NO. : 10/091137
DATED : September 7, 2004
INVENTOR(S) : Daniel Bone It is certified that error appears in the above-identified patent and that said Letters Patent is hereby corrected as shown below:

Column 14,
Line 3, after "containing" insert -- surface --.

Signed and Sealed this

Fifteenth Day of January, 2008

JON W. DUDAS
*Director of the United States Patent and Trademark Office*

UNITED STATES PATENT AND TRADEMARK OFFICE

CERTIFICATE OF CORRECTION

PATENT NO. : 6,785,932 B2
APPLICATION NO. : 10/091137
DATED : September 7, 2004
INVENTOR(S) : Daniel Bone It is certified that error appears in the above-identified patent and that said Letters Patent is hereby corrected as shown below:

Column 14,
Line 3, after "containing" insert -- surface --.

Signed and Sealed this

Twenty-ninth Day of January, 2008

JON W. DUDAS
*Director of the United States Patent and Trademark Office*